United States Patent [19]

Mueller

[11] 4,303,283

[45] Dec. 1, 1981

[54] DISPLAY CABINET WITH STABILIZED ROTATING SHELF MECHANISM

[76] Inventor: Richard J. Mueller, 6155 Old Hickory Point, Atlanta, Ga. 30328

[21] Appl. No.: 149,434

[22] Filed: May 13, 1980

[51] Int. Cl.[3] ..... A47B 49/00; A47F 3/10

[52] U.S. Cl. ..... 312/135; 312/266; 312/305; 211/164; 108/94

[58] Field of Search ..... 312/135, 125, 202, 266, 312/252, 305; 108/94, 95; 211/144, 164

[56] References Cited

U.S. PATENT DOCUMENTS

| | | | |
|---|---|---|---|
| 125,928 | 4/1872 | Blake | 211/164 |
| 380,897 | 4/1888 | Jewell | 108/95 |
| 518,526 | 4/1894 | Jewett | 108/94 |
| 920,538 | 5/1909 | Cannon | 211/144 |
| 950,961 | 3/1910 | Sandifur | 211/164 |
| 1,269,825 | 6/1918 | Langdon | 108/95 |
| 1,867,145 | 7/1932 | Godfrey | 211/164 |
| 1,893,552 | 1/1933 | King | 312/266 |
| 1,920,663 | 8/1933 | Palmer | 108/95 |
| 1,988,917 | 1/1935 | Rauch | 312/135 |
| 2,138,190 | 11/1938 | Myers | 312/305 |
| 2,589,598 | 3/1952 | Belen | 312/305 |
| 2,646,891 | 7/1953 | Morgan | 312/135 |
| 2,853,353 | 9/1958 | Schofield et al. | 312/266 |
| 2,927,545 | 3/1960 | Hieb | 108/95 |
| 3,038,773 | 6/1962 | Vasbinder, Sr. | 312/252 |
| 3,732,829 | 5/1973 | Bech | 108/95 |

*Primary Examiner*—Victor N. Sakran

*Attorney, Agent, or Firm*—Newton, Hopkins & Ormsby

[57] ABSTRACT

A low cost, reliable and simplified mechanism is disclosed for maintaining a set of rotating shelves in a display cabinet level and stable at all ponts on their circular path of travel. The display cabinet can be heated or refrigerated where perishable goods are being displayed.

14 Claims, 7 Drawing Figures

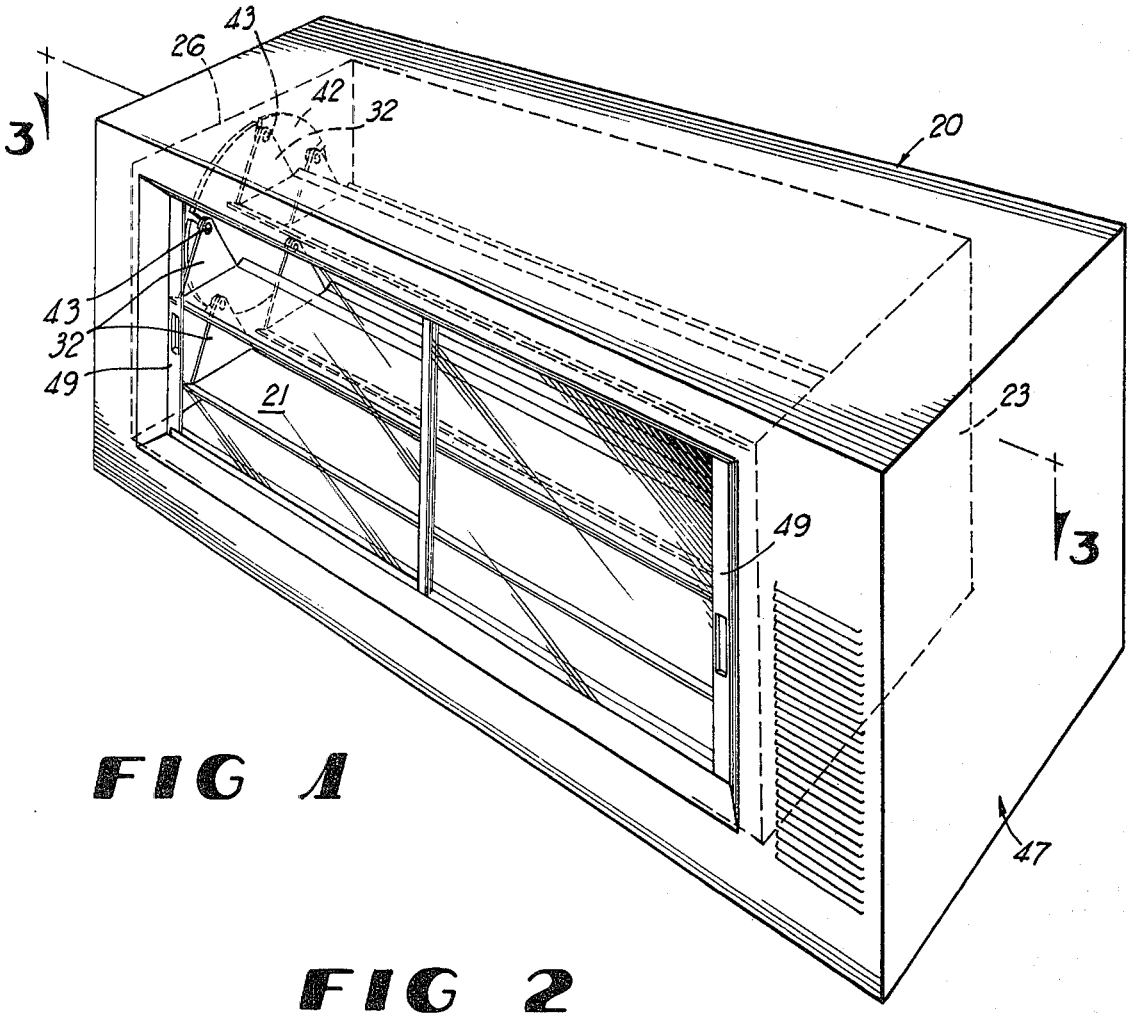
FIG 1
FIG 2
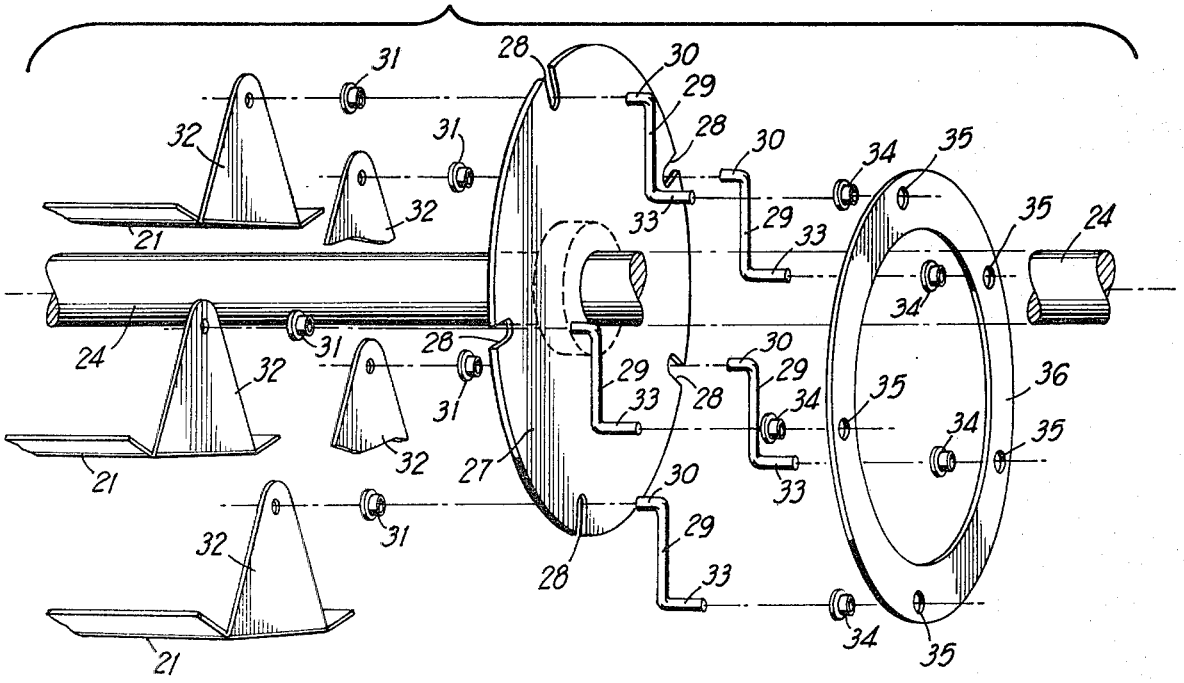

DISPLAY CABINET WITH STABILIZED ROTATING SHELF MECHANISM

BACKGROUND OF THE INVENTION

The present invention relates to improvements in display cabinets of the type employing a plurality of rotating shelves to carry goods to and from a viewing window in one side of the cabinet. More particularly, the invention seeks to simplify and reduce the cost of manufacturing of a drive mechanism which maintains the rotating shelves level at all times and stabilizes them, so that they will not tend to swing on their suspension pivots during rotation. By means of the invention, the above objectives are fully realized without the need for close machining tolerances or expensive mechanical components. The mechanism is also compact and practically maintenance-free.

Other features and advantages of the invention will become apparent to those skilled in the art during the course of the following description.

BRIEF DESCRIPTION OF THE DRAWINGS

FIG. 1 is a perspective view of a display cabinet equipped with rotating shelf mechanism in accordance with the invention.

FIG. 2 is a fragmentary exploded perspective view of the mechanism.

DETAILED DESCRIPTION

Figure 3:
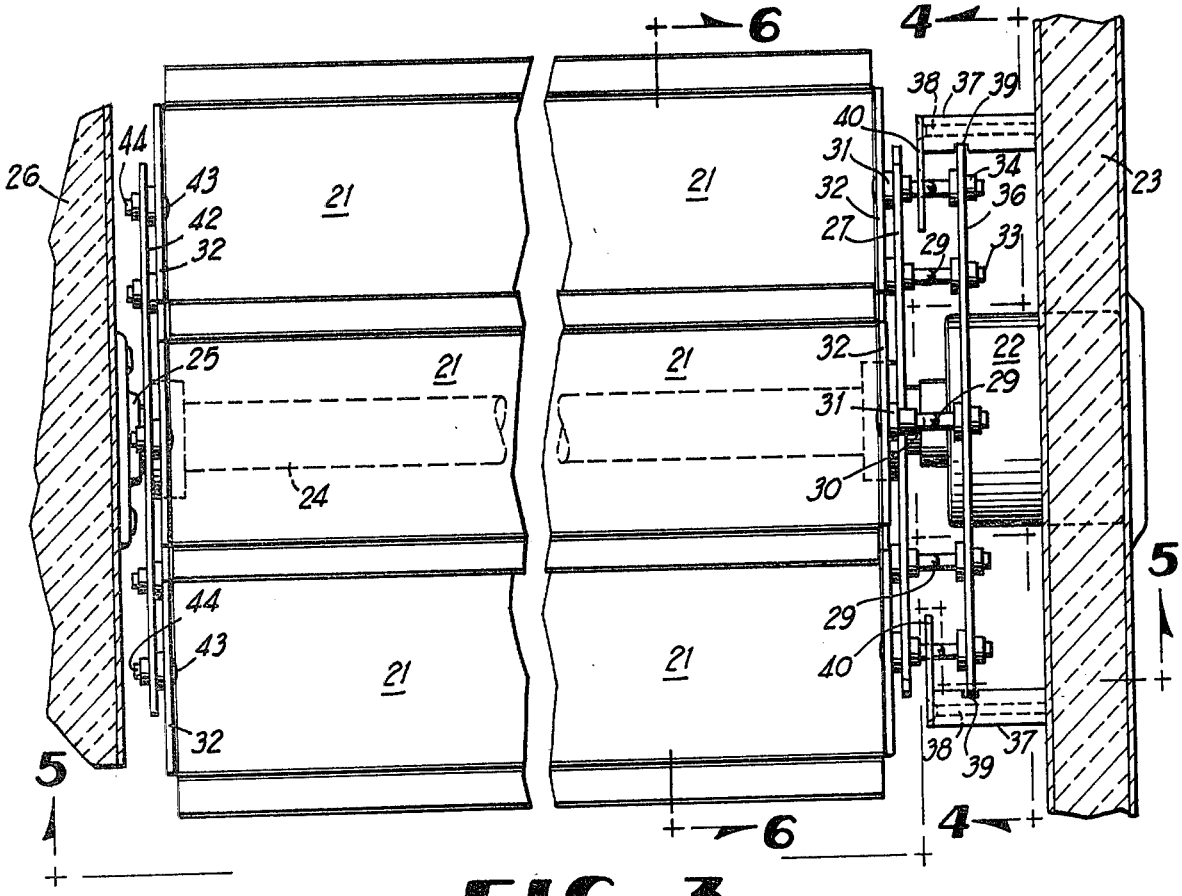
FIG. 3 is a fragmentary horizontal section taken on line 3—3 of FIG. 1.

Referring to the drawings in detail wherein like numerals designate like parts, a display cabinet 20 for merchandise houses a series of rotating shelves 21 which support the merchandise being displayed. A drive motor 22 mounted on one end wall 23 of the cabinet 20 is operatively coupled with and drives a main drive shaft 24 extending lengthwise of and arranged centrally in the display cabinet. The far end of the drive shaft 24 is journaled in a suitable bearing 25 on the adjacent cabinet end wall 26.

A disc 27 having circumferentially equidistantly spaced radial slots 28 in its peripheral edge is fixed on the drive shaft 24 near the motor 22 and revolves with the drive shaft. A corresponding number of crank links 29 have their corresponding end extensions 30 received in bushings 31 formed of dry lube material, and these bushings engage in the radial slots 28 of disc 27.

The merchandise shelves 21 which correspond in number to crank links 29 and slots 28 have rising end walls 32 to which the link extensions 30 are rigidly connected as by welding. The far end terminals 33 of crank links 29 are parallel to the extensions 30 and are received in dry lube bushings 34 which in turn engage freely or loosely in openings 35 of a ring 36 disposed axially outwardly of the disc 27 in parallel relation thereto. As rotation is imparted by drive shaft 24 to the disc 27 which is concentric with the drive shaft, the ring 36 which is eccentrically disposed is caused to follow the disc through the driving action of the links 29 on the ring 36.

During such driving action, the ring 36 is constrained against horizontal displacement by a pair of diametrically opposed vertical members 37 fixed to the adjacent side wall 23 by screws 38. These vertical members have opposing longitudinal vertical grooves 39 formed therein which receive the peripheral edge portion of the ring 36. The ring 36 is floatingly arranged in the grooves 39 of members 37.

Guide members 37 carry interior flanges 40 rigid therewith at right angles thereto, which flanges are located between the disc 27 and ring 36, FIG. 3. During rotation of the disc 27, as each radial slot 28 reaches the three o'clock or nine o'clock position, FIG. 4, an arcuate edge 41 on the flange 40 comes into engagement with the terminal 30 of each crank link 29 preventing each crank link from being displaced radially outwardly in the slot 28, which otherwise might occur if the retaining flange 40 were not present. At other points during rotation of the disc 27 ahead of and after the three o'clock and nine o'clock positions, there is no need for the edge 41 since the crank links themselves will hold the extensions 30 and their bushings 31 in the radial slots 28.

Figure 4:
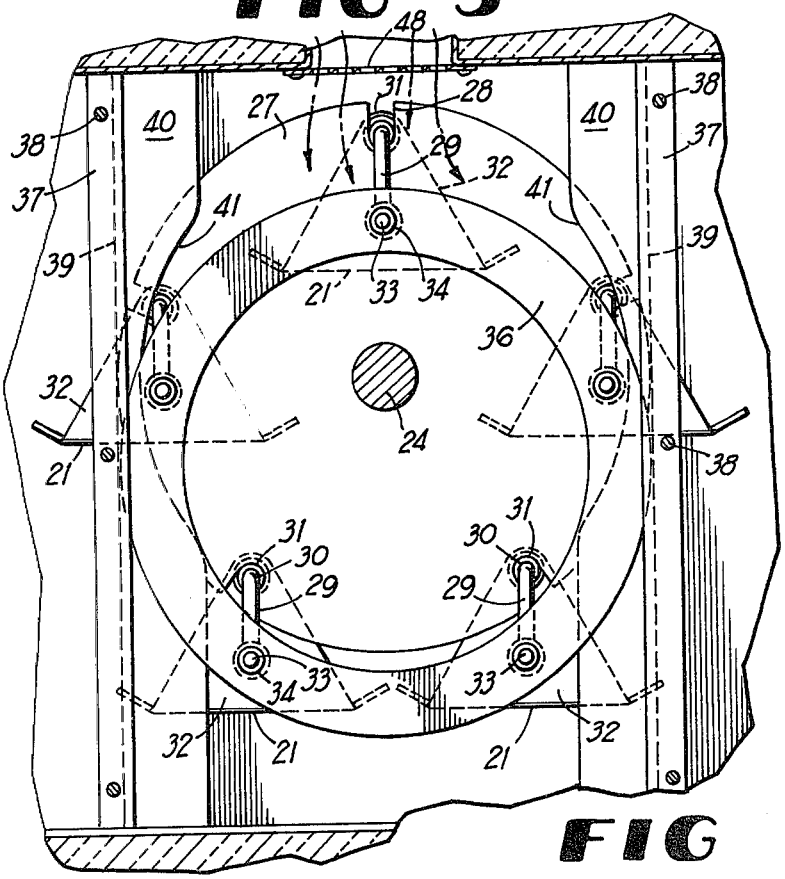
FIG. 4 is a transverse vertical section taken on line 4—4 of FIG. 3.
Figure 5:
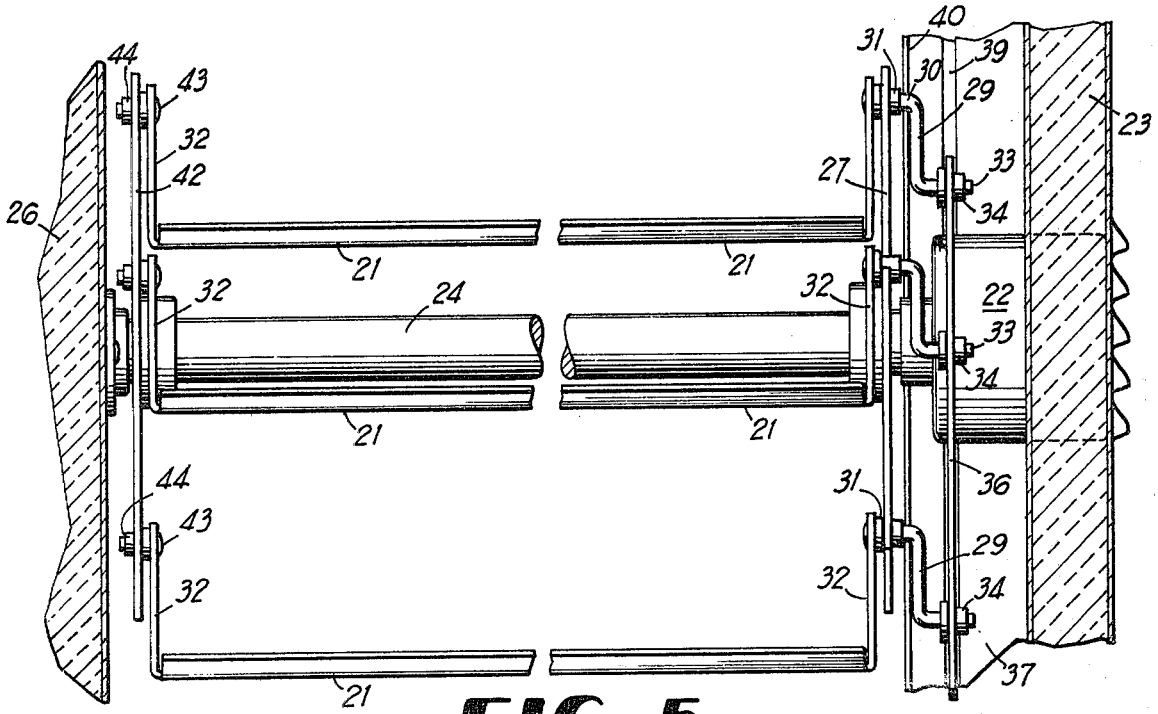
FIG. 5 is a horizontal section taken on line 5—5 of FIG. 3.
Figure 6:
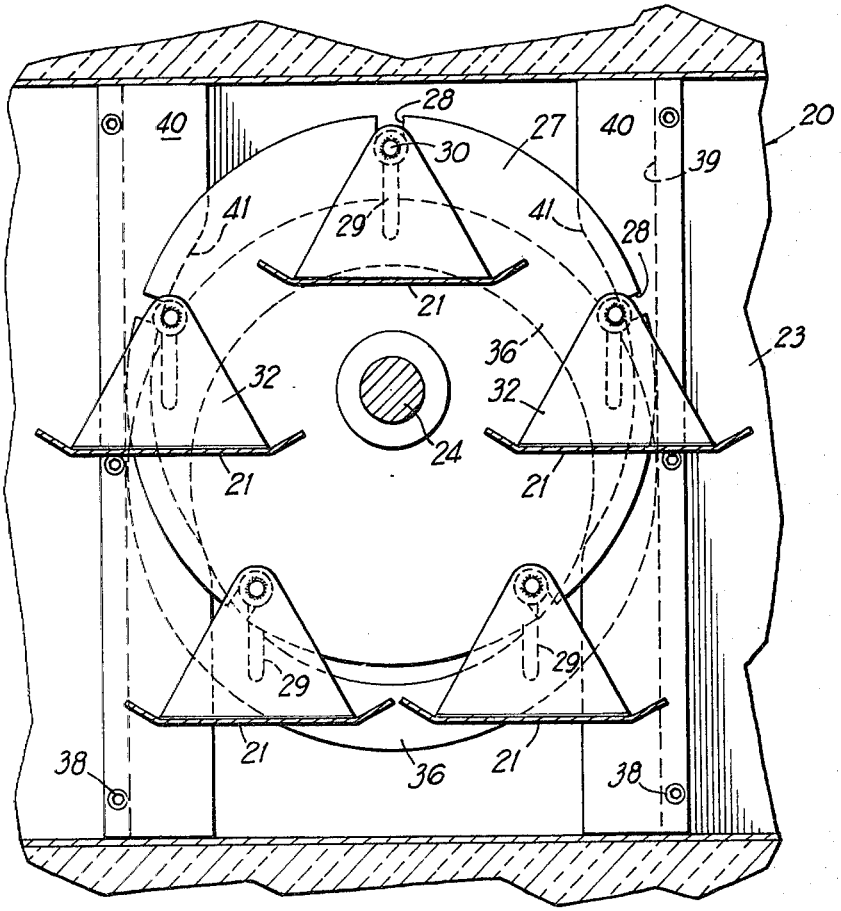
FIG. 6 is a transverse vertical section taken on line 6—6 of FIG. 3.

During the rotation of shaft 24 and disc 27, referring to FIG. 4, the links 29 remain parallel and remain vertical regardless of the angular position of the disc 27 and the ring 36. The disc and ring will turn in unison and the ring will remain eccentrically disposed to the common axis of drive shaft 24 and disc 27. The several shelves 21 will remain level at all times during the rotational cycle and cannot swing on the axes of extensions 30.

The levelness of the rotating shelves 21 can be accurately adjusted in the assembling of the mechanism by adjusting the two members 37 laterally relative to the axis of drive shaft 24. As viewed in FIG. 4, when the two parallel members 37 are adjusted to the left, all of the shelves 21 will be rotated clockwise around the axes of extensions 30. Similarly, when members 37 are adjusted to the right in FIG. 4, the shelves will turn counterclockwise. By virtue of this adjustment, the display shelves can be accurately leveled in a simple and economical manner. The end walls 32 of shelves 21 adjacent to the shaft bearing 25 are suspended from a disc 42 mounted on the drive shaft 24 through a series of pins 43 having dry lube bushings 44. The pins 43 are in axial alignment with link extensions 30 at the far ends of the shelves adjacent to the drive mechanism.

Figure 7:
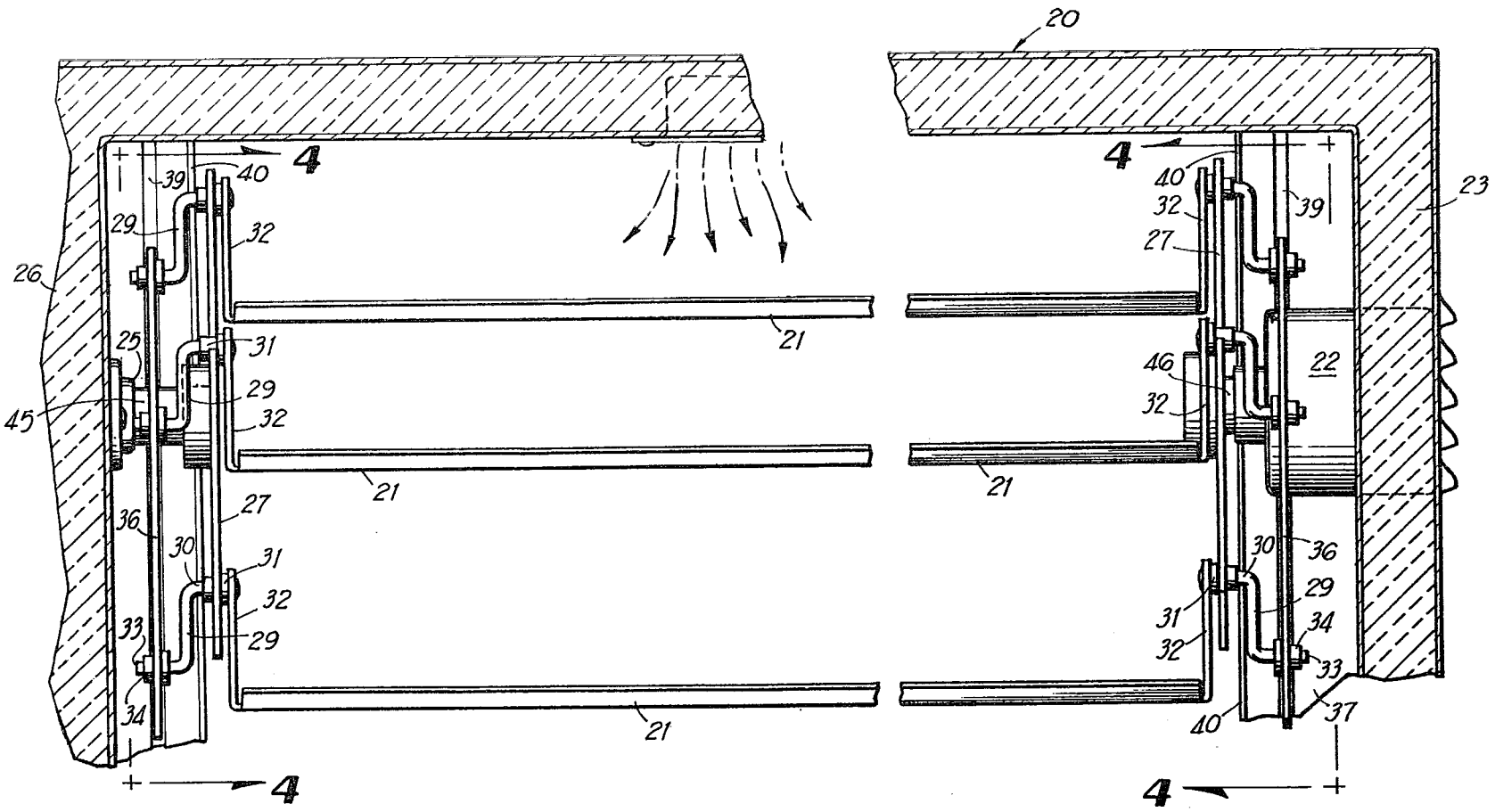
FIG. 7 is a view similar to FIG. 5 showing a modification of the invention.

In the modification shown in FIG. 7, the comparatively costly main drive shaft 24 can be eliminated without loss of its function. To enable this, the described drive mechanism including disc 27, ring 36, links 29 and associated parts including members 37 is duplicated at the ends of the shelves 21 away from the motor 22 and the driving force for rotation is transmitted through the shelves themselves. A short stub shaft 45 held in bearing 25 supports the disc 27 away from the motor 22 and the motor drives a similar short shaft 46 to which the near disc 27 is attached.

The display cabinet in either form can be used with various goods, such as jewelry or perishable products. In the latter case, it may be desirable to heat, cool and/or ventilate the display cabinet. A heat exchange unit, not shown, including a blower, for refrigeration or heating, can be housed in a provided end space 47, FIG. 1, of cabinet 20 to deliver hot or cold air to the interior of the cabinet at 48, see FIGS. 3 and 7.

The cabinet includes at least front sliding doors 49 which are transparent and may include similar rear doors for the loading of merchandise after same are removed by customers through the front doors 49. The rear doors are omitted in the drawings. A switch, not shown, triggered by operation of the doors 49 will shut off the blower whenever the doors are opened, in cases where the heat exchange unit is used.

While the invention has been disclosed in this application as a mechanism for maintaining the rotating shelves of a display cabinet level and stable during their orbital movement, it should be understood that the mechanism forming the subject matter of the invention is fully capable of additional and more general usage and may, for example, form the drive mechanism for various devices which require continuous orbital movement with the leveling and stablizing advantages afforded by the invention.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A display cabinet for merchandise comprising a cabinet body, a rotational drive motor mounted on one wall of the cabinet body, a disc having circumferentially spaced openings drivingly coupled to said motor and being concentric with a drive shaft axis of the motor, a ring spaced axially of the disc and being eccentrically positioned relative thereto and having circumferentially spaced openings corresponding in number and spacing to the openings of the disc, crank links drivingly interconnecting the disc and ring whereby rotation of the disc causes the ring to follow in rotation while maintaining its eccentric relationship to the disc, opposite side locator members for the ring in the cabinet body, circumferentially placed display shelves in the cabinet body spaced from one side of said disc and having corresponding ends fixedly attached to said crank links, and the spaced openings of said disc consisting of radial slots opening through the periphery of the disc, said locator members having opposing parallel grooves receiving peripheral edge portions of said ring, and opposing projecting flanges on said locator members having arcuate retainer edges preventing the escape of said crank links from said disc radial slots when said slots are substantially at three o'clock or nine o'clock positions on said disc during the rotation of the disc.

2. A display device as defined in claim 1, and dry lube bushings receiving the terminals of said links and engaging within the spaced openings of said disc and ring.

3. A display cabinet as defined in claim 1, and said crank links being generally Z-shaped and having spaced parallel terminals aligned with the spaced openings of the disc and ring and connected therein, and the crank links including shanks interconnecting said terminals and disposed in parallel relationship during rotation of the disc and ring.

4. A display cabinet as defined in claim 1, wherein said display shelves are elongated and parallel, a drive shaft driven to rotation by said motor and extending adjacent to the ends of the shelves away from the motor, and support means for the last-named ends of the shelves on the drive shaft.

5. A display cabinet as defined in claim 4, and a support bearing for the end of the drive shaft away from the motor on an adjacent wall of said cabinet body.

6. A display device comprising rotational drive motor means, at least a disc having circumferentially spaced openings drivingly coupled to the motor means, links corresponding in number to said disc openings and coupled with said openings, merchandise display shelves fixed to first terminals of said links adjacent to said disc openings, a circumferential connecting element common to all of said links and having circumferentially spaced openings corresponding in number and spacing to the disc openings, the openings of the circumferential connecting element being coupled with second terminals of the links, the circumferential connecting element being eccentrically located relative to the disc on one orthogonal axis, means engaging the circumferential connecting element and positively restraining it on a second orthogonal axis, and said disc spaced openings comprising slots opening through the periphery of the disc, and stationary means at diametrically opposite points on the disc preventing the escape of said links from said slots at three o'clock and nine o'clock positions.

7. A display device as defined in claim 6, and rotational support means for said shelves at their ends away from said disc, said disc, said motor means, said circumferential connecting element and said links being located near corresponding ends of said shelves.

8. A display device as defined in claim 6, and orbital support means for the ends of said shelves away from said drive motor means.

9. A display device as defined in claim 8, and said orbital support means comprising a duplicate arrangement of said disc, circumferential connecting element, links, said means engaging the circumferential connecting element and said stationary means.

10. An orbital drive mechanism comprising support means, a rotational drive motor mounted on the support means, a disc having circumferentially spaced openings drivingly coupled to said motor and being concentric with a drive shaft axis of the motor, a ring spaced axially of the disc and being eccentrically positioned relative thereto and having circumferentially spaced openings corresponding in number and spacing to the openings of the disc, crank links drivingly interconnecting the disc and ring whereby rotation of the disc causes the ring to follow in rotation while maintaining its eccentric relationship to the disc, opposite side locator members for the ring on said support means, circumferentially spaced members spaced from one side of said disc and having corresponding ends fixed to said crank links, and the spaced openings of said disc consisting of radial slots opening through the periphery of the disc, said locator members having opposing parallel grooves receiving peripheral edge portions of said ring, and opposing projecting flanges on said locator members having arcuate retainer edges preventing escape of said crank links from said disc radial slots when said slots are substantially at three o'clock or nine o'clock positions on said disc during rotation of the disc.

11. An orbital drive mechanism as defined in claim 10, and dry lube bushings receiving the terminals of said links and engaging within the spaced openings of said disc and ring.

12. An orbital drive mechanism as defined in claim 10, and said crank links being generally Z-shaped and having spaced parallel terminals aligned with the spaced openings of the disc and ring and being connected therein, and the crank links including shanks interconnecting said terminals and disposed in parallel relationship during rotation of the disc and ring.

13. An orbital drive mechanism comprising rotational drive motor means, at least a disc having circumferentially spaced openings drivingly coupled to the motor means, links corresponding in number to said disc openings and coupled with said openings, orbital members fixed to first terminals of said links adjacent to said disc openings, a circumferential connecting element common to all of said links and having circumferentially spaced openings corresponding in number and spacing to the disc openings, the openings of the circumferential connecting element being coupled with second terminals of the links, the circumferential connecting element being eccentrically located relative to the disc on a first orthogonal axis, means engaging the circumferential connecting element and positively restraining it on a second orthogonal axis, and said disc spaced openings comprising slots opening through the periphery of the disc, and stationary means at diametrically opposite points on the disc preventing escape of said links from said slots at three o'clock and nine o'clock positions.

14. An orbital drive mechanism as defined in claim 13, and rotational support means for said orbital members at their ends away from said disc, said disc, said drive motor means, said circumferential connecting element and said links being located near corresponding ends of said orbital members.

* * * * *